United States Patent [19]

DeVito

[11] 3,981,343

[45] Sept. 21, 1976

[54] COUNTERBALANCING MECHANISM FOR ROLLING DOORS

[75] Inventor: George DeVito, Chicago, Ill.

[73] Assignee: Arthur M. Brady, Chicago, Ill.

[22] Filed: Sept. 23, 1974

[21] Appl. No.: 508,404

[52] U.S. Cl. ..... 160/9; 160/133; 160/190; 160/193

[51] Int. Cl.[2] ..... E05F 15/20

[58] Field of Search ..... 160/133, 191, 193, 1, 160/201, 9, 190

[56] References Cited

UNITED STATES PATENTS

| | | | |
|---|---|---|---|
| 777,648 | 12/1904 | Ballinger et al. | 160/1 X |
| 991,605 | 5/1911 | Burne | 160/133 X |
| 1,722,250 | 7/1929 | McKee | 160/191 |
| 1,863,961 | 6/1932 | Ball et al. | 160/201 X |

*Primary Examiner*—Kenneth Downey

*Attorney, Agent, or Firm*—Leydig, Voit, Osann, Mayer & Holt, Ltd.

[57] ABSTRACT

A counterbalancing mechanism for an articulated rolling door mounted for movement horizontally away from the doorway when the door is opened, with the weight of the vertical portion of the door producing variable forces urging the door towards its closed position as the door is moved between its open and closed positions. A drum is connected to the door and mounted for rotation in response to movement of the door between its open and closed positions, the drum having a spiral groove formed in the outer surface for guiding a cable along the drum when the drum is rotated. A cable is connected to the drum and adapted to wrap around the drum in the spiral groove in response to rotation of the drum in one direction, and to unwrap from the drum in response to rotation in the opposite direction. A weight is suspended from the cable for applying a torque to the drum, and thus applying a force to the door, urging the door toward its open position. The radius of curvature of the spiral groove about the axis of the drum gradually decreases along the length of the drum so that the torque arm between the axis of the drum and the cable gradually decreases as the cable moves along the spiral groove for counterbalancing the variable forces urging the door toward its closed position. At the small end of the drum, the spiral groove preferably approaches the axis of the drum to reduce the torque arm to substantially zero when the door is in its open position. In one embodiment, a secondary cable is connected to a secondary drum having a conventional spiral groove, with this secondary cable being connected to the door for decreasing the torque exerted on the secondary drum as the door is moved toward its closed position. This secondary cable and drum permit the use of a smaller rate of change in the radius of curvature of the spiral groove in the primary drum than would otherwise be required. For safety purposes, a brake means may be connected to the drum for automatically locking the drum and preventing further movement of the door in response to a malfunction in the counterbalancing mechanism.

7 Claims, 6 Drawing Figures

53
52
50a
57
55
56
16
51
54
50
30
33
34
63
66
40
60
39
36
35
62
61
41
64
65

COUNTERBALANCING MECHANISM FOR ROLLING DOORS

DESCRIPTION OF THE INVENTION

The present invention relates generally to articulated rolling doors for garages and the like and, more particularly, to counterbalancing mechanisms for such doors.

Articulated rolling doors are normally mounted for movement horizontally away from the doorway when the door is opened. For example, the door may follow an arcuate track leading from the vertical doorway to a horizontal track section where the door is stored while it is opened, or the door may simply be rolled around a shaft or tube so that the door is stored in a more compact form. In any event, the fact that different portions of the door lie in the vertical plane of the doorway while the door is moved between its open and closed positions causes a variation in the magnitude of the gravitational forces urging the door toward its closed position. That is, when the door is in its closed position, with substantially the entire door lying in the vertical plane, the gravitational forces urging the door toward the closed position are at a maximum. On the other hand, when the door is in its open position where there is no substantial portion of the door lying in the vertical plane, the gravitational forces urging the door toward its closed position are substantially zero. As the door moves between the open and closed positions, the door is continuously urged toward its closed position by gravitational forces acting on the door, but the magnitude of these forces continuously varies, depending on the particular position of the door at any given time.

To provide smooth operation of such doors, the varying gravitational forces acting on the door are normally counterbalanced in some way so that the door does not crash against the floor when it is closed. The counterbalancing also makes it easier to open the door and prevents the door from crashing into its storage position in the event that it is opened with a constant lifting force (while the resistance of the door diminishes). In most conventional rolling door systems today, the desired counterbalancing is achieved by means of a torsional spring which biases the door toward its open position with a force which gradually increases as the door moves from its open position to its closed position. Thus, while the door is being closed, the biasing force of the spring gradually increases to counterbalance the gradually increasing gravitational forces acting on the door as more and more of the door is moved into the vertical plane of the doorway. Conversely, when the door is moved from its closed position to its open position, the biasing spring force gradually diminishes so that a constant lifting force applied to the door will open it at a substantially uniform rate. This is particularly desirable when the door is being lifted by an electric motor rather than manually. The variable spring biasing force is produced by coiling and uncoiling the torsional spring in response to rolling movement of the door between its open and closed positions.

While the use of torsional springs provides the desired counterbalancing effect, the use of such springs gives rise to troublesome maintenance problems. Depending upon the frequency with which the door is opened and closed, the springs eventually break and must be replaced. This is a time-consuming operation because the springs are normally located above the doorway, and the broken spring must be removed from the mechanism connecting it to the rolling door, and then the new spring connected to that same mechanism. In a typical installation, this servicing may require several hours of work by two or more men. Moreover, since the springs are located directly above the doorway, it is generally necessary for the doorway to be obstructed in some manner while the springs are being replaced. This is particularly annoying in commercial installations where the door might be normally opened and closed every few minutes, at least during certain portions of the day.

It is, therefore, a primary object of the present invention to provide a rolling door counterbalancing mechanism which has a long operating life and which can be easily and quickly serviced when a malfunction occurs. In this connection, a related object of the invention is to provide an improved rolling door counterbalancing mechanism which does not require the use of torsional springs.

It is another object of this invention to provide such an improved rolling door counterbalancing mechanism which can be mounted off to the side of the doorway so that it can be easily serviced without obstructing the doorway during servicing.

A further object of the invention is to provide an improved rolling door counterbalancing mechanism of the foregoing type which can be efficiently manufactured at a low cost, particularly for relatively large doors.

Still another object of this invention is to provide an improved rolling door counterbalancing mechanism of the type described above which can be easily modified to provide the optimum counterbalancing characteristics for virtually any desired number of different doors.

Other objects and advantages of the invention will be apparent from the following descriptions and the accompanying drawings, in which.

While the invention will be described in connection with certain preferred embodiments, it will be understood that it is not intended to limit the invention to those particular embodiments. On the contrary, it is intended to cover all alternatives, modifications and equivalent arrangements as included within the spirit and scope of the invention as defined by the appended claims.

Figure 1:
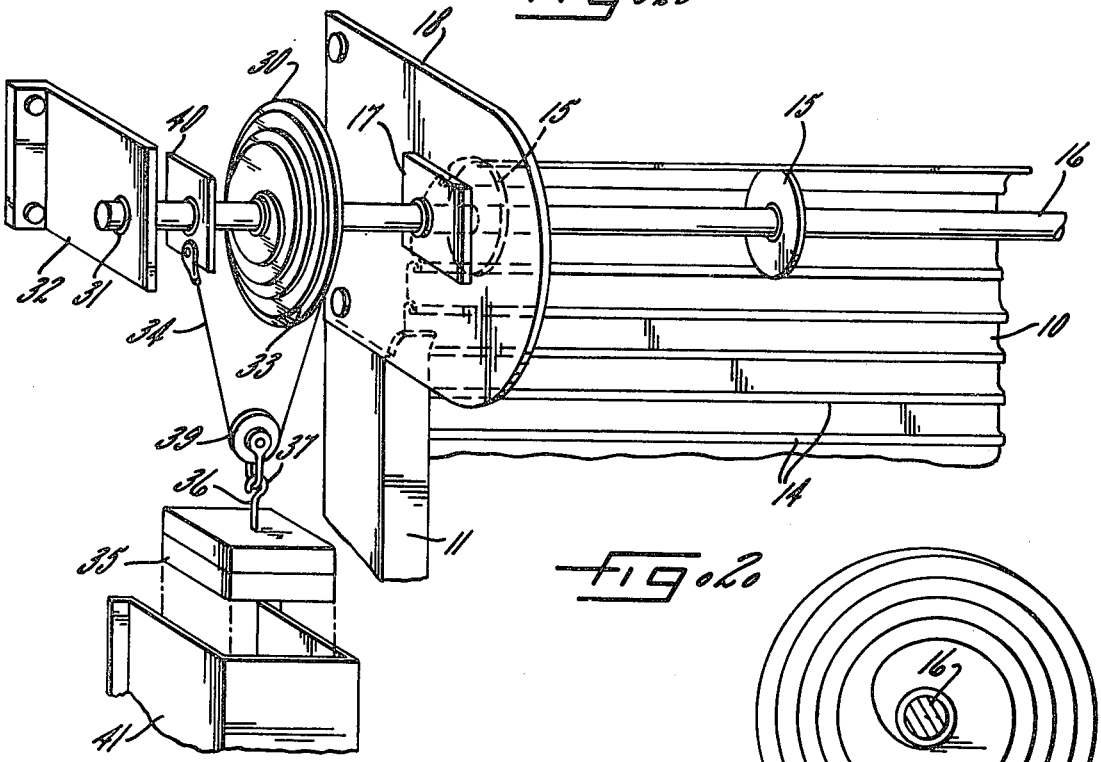
FIG. 1 is a perspective view of a portion of a conventional rolling door connected to a counterbalancing mechanism embodying the invention.
Figure 2:
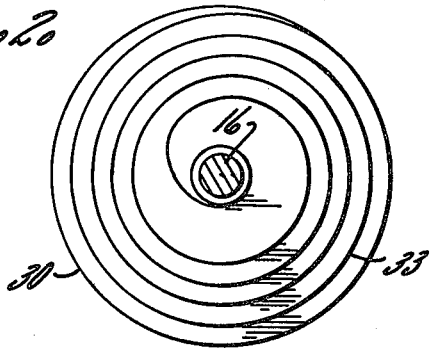
FIG. 2 is an enlarged end elevation of the cable drum in the counterbalancing mechanism of FIG. 1.
Figure 3:
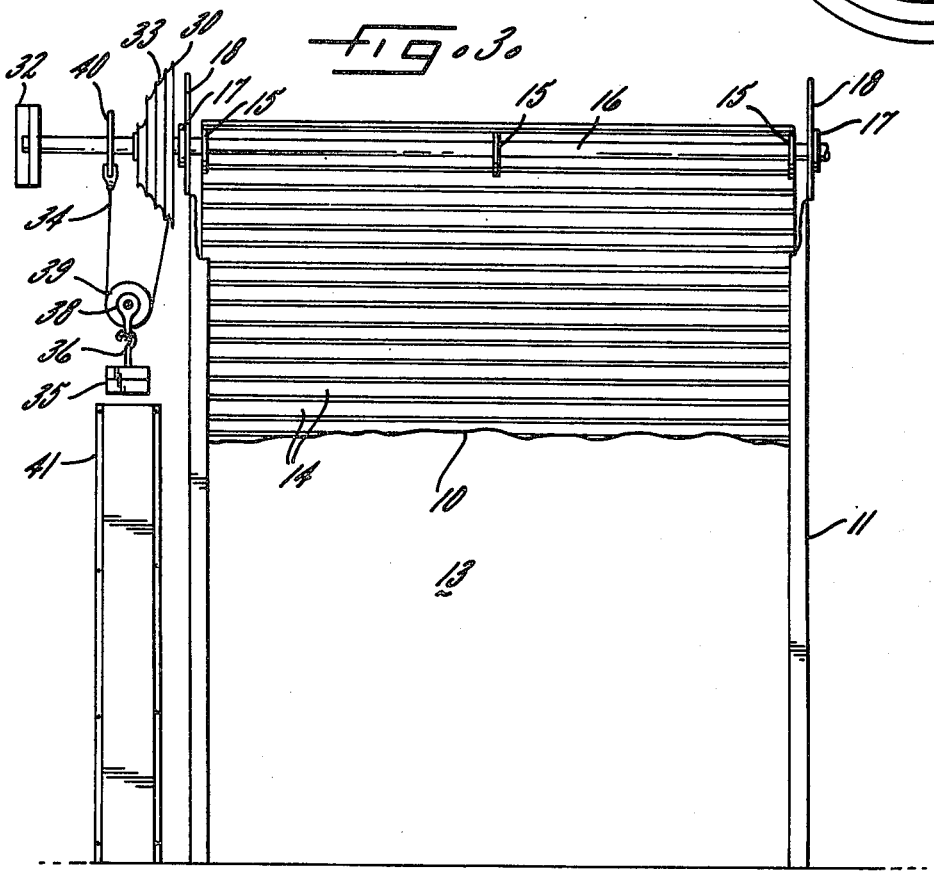
FIG. 3 is a full elevation, on a reduced scale, of the door and counterbalancing mechanism shown in FIG. 1, with fragments of the door tracks broken away for clarity.

Turning now to the drawings and referring first to FIGS. 1-3, an articulated steel rolling door 10 is mounted for vertical movement in a pair of vertical guides 11 mounted on opposite sides of a doorway 13. In the particular example illustrated, the door 10 comprises a plurality of interconnected horizontal slats 14 which are free to pivot relative to each other about horizontal axes. Although not shown in the drawings, it will be understood that such doors are normally provided with lugs at the lower ends thereof for abutting stops at the upper ends of the guides 11. The top of the door 10 is connected to a plurality of horizontally spaced disks 15 mounted on a shaft 16 journalled in bearing plates 17 in a pair of supporting end plates 18. To open the door 10, the shaft 16 is turned in a clockwise direction as viewed in FIG. 1 so as to cause the door to coil around the disks 15. To close the door 10, the shaft 16 is rotated in the counterclockwise direction so that the weight of the door pulls it down through the guides 11, uncoiling it from the disks 15.

As explained previously, the greater the length of door uncoiled from the disks 15, i.e., the greater the length of door extending in the vertical direction, the greater will be the gravitational forces tending to lower the door. Consequently, in the absence of a counterbalancing mechanism, the door would be lowered with increasing acceleration so that it would crash against the floor at the lower ends of the guides 11. Then to open the door it would be necessary to initially lift substantially the entire weight of the door. This weight would gradually diminish as the door coiled around the disks 15, so that if a constant lifting force were applied to the door throughout its entire length of travel, the door would again move with increasing acceleration so it would crash hard against the stops provided at the upper ends of the guides 11.

In accordance with one important aspect of the present invention, the counterbalancing mechanism for the door 10 comprises a drum connected to the door and mounted for rotation in response to movement of the door between its open and closed positions, the drum having a spiral groove extending along the outer surface thereof with a continuously varying radius of curvature that approaches the axis of the drum at one end thereof. A cable is connected to the drum so that the cable is wrapped around the drum in the spiral groove in response to rotation of the drum in one direction and is unwrapped from the drum in response to rotation in the opposite direction. A weight is suspended from the cable for applying to the drum a torque which varies in accordance with the location of the cable along the spiral groove, thereby applying a variable force to the door which counterbalances the variable gravitational forces acting on the door as it is moved between its open and closed positions. Thus, in the illustrative embodiment of the invention in FIGS. 1–3, a drum 30 is fixed to the shaft 16 on the outboard side of the end plate 18. To support the free end of the shaft 16, it extends through a bearing 31 in an axillary mounting plate 32. The outer surface of the drum 30 forms a spiral groove 33 for guiding a cable 34 which is secured to the drum 30 at one end of the groove.

Because the drum 30 is fixed to the shaft 16, the drum rotates in response to movement of the door 10 between its open and closed position, thereby wrapping and unwrapping the cable 34 on the drum 30 along the spiral groove 33. More specifically, when the door 10 is in its closed position, the cable 34 is wrapped around substantially the entire length of the drum 30 so that the depending portion of the cable 34 is tangent to the maximum diameter of the drum 30 at the right-hand end thereof. When the door 10 is in its open position, the cable 34 is completely unwrapped from the drum 30 so that the depending portion of the cable 34 is tangent to the minimum diameter of the drum at the left-hand end thereof.

For the purpose of applying a counterbalancing torque to the shaft 16, a set of weights 35 are suspended from the depending portion of the cable 34 below the drum 30. More particularly, the weights are mounted on a rod 36 having a top hook 37 fitting through an eye 38 depending from a pulley 39. The pulley 39 rides on the cable 34 between the drum 30 and a bearing plate 40 supporting the end of the cable 34. This bearing plate 40 is preferably mounted on the shaft 16, although it could be mounted on a stationary portion of the frame or building if desired. Consequently, the weights 35 continuously pull the cable 34 downwardly, tensioning it between the drum 30 and the bearing plate 40, with the weights 35 moving in a vertical direction through a guide box 41 in response to rotation of the drum 30. That is, whenever the drum 30 is rotated in response to movement of the door 10, the cable 34 is either wrapped onto or unwrapped from the drum 30, causing the weights 35 to move upwardly or downwardly through the guide box 41.

Although the force exerted on the cable 34 by the weights 35 is constant, the torque applied to the shaft 16 depends upon the location of the cable 34 on the drum 30 at any given time. That is, if the cable is completely unwrapped from the drum so that the depending portion of the cable 34 engages the drum at the left-hand end where the drum diameter is a minimum, the weights 35 exert substantially no torque on the shaft 16 because the torque arm is substantially zero at that point. When the cable is completely wrapped around substantially the entire length of the drum 30 so that the depending portion of the cable 34 engages the right-hand end of the drum where the diameter is a maximum, the weights 35 exert a maximum torque on the drum 30 because the torque arm is a maximum at that point. At intermediate positions of the cable 34, where it is wrapped around only a part of the length of the drum 30, the weights 35 exert an intermediate magnitude of torque on the drum 30 because the depending portion of the cable 34 engages the drum at an intermediate diameter where the torque arm is of an intermediate length.

In keeping with the invention, it has been found that the radius of curvature of the spiral groove 33 cannot change at a uniform rate if it is to provide the requisite counterbalancing effect on the rolling door 10. Thus, as shown most clearly in FIG. 2, the radius of curvature of the spiral groove 33 decreases at an increasing rate as it approaches the shaft 16, and it terminates on a tangent with the inside diameter of the drum 30. Consequently, as the cable is unwrapped from the drum 30 in response to opening of the door, the torque diminishes at an increasing rate and is substantially zero when the cable is completely unwrapped, because the force exerted by the weights 35 is applied at a substantially zero torque arm. Conversely, as the cable is wrapped onto the drum 30 in response to closing of the door, the torque increases at a diminishing rate and is a maximum when the cable is wrapped around the entire length of the drum, because the force exerted by the weights 35 at that point is applied at the maximum torque arm.

In accordance with a further aspect of the present invention, one end of the cable is connected to the drum and the other end is fixed, with the weight suspended from an intermediate portion of the cable so that the weight displacement relative to the drum is only a fraction of the cable displacement relative to the drum. Thus, in the illustrative embodiment of FIGS. 1–3, the weights 35 are suspended from a point between the two ends of the cable 34, rather than being suspended from a depending end of the cable. As a result, while the entire force of the weights 35 is supported by the shaft 16, only half of that force is transmitted to the shaft 16 via the drum 30. This is a disadvantage in that it reduces the counterbalancing effect of the weights 35, but this disadvantage is offset by the fact that the vertical displacement of the weights 35 is only half of what it would be if the weights were suspended from the end of the cable 34. Of course, the vertical space available for travel of the weights 35 is limited by the height of the doorway 13, and thus it is an important advantage for the length of vertical travel of the weights 35 to be limited in this manner.

In accordance with a further feature of this invention, the cable carrying the counterbalancing weight is secured to a braking device on the drum shaft, the braking device being response to a reduction in the weight on the cable for locking the shaft against rotation so that the shaft is automatically locked in the event of a malfunction in the counterbalancing mechanism. Thus, in the particular embodiment illustrated in FIGS. 4 and 5, the cable 34 is connected to the lower end of an inverted L-shaped actuator 50 pivoted on a bearing 51 on the shaft 16. The horizontal upper arm 50a of the actuator 50 supports a lever 52 pivoted about a point 53 and having a weight 54 attached to one end and a brake pad 55 attached to the other. As long as the cable 34 is tensioned by the counterbalancing weights 35, the actuator 50 remains in the position shown in FIGS. 4 and 5 with the arm 50a supporting the lever 52 against the biasing force of the weight 54.

Figures 4, 5, 6:
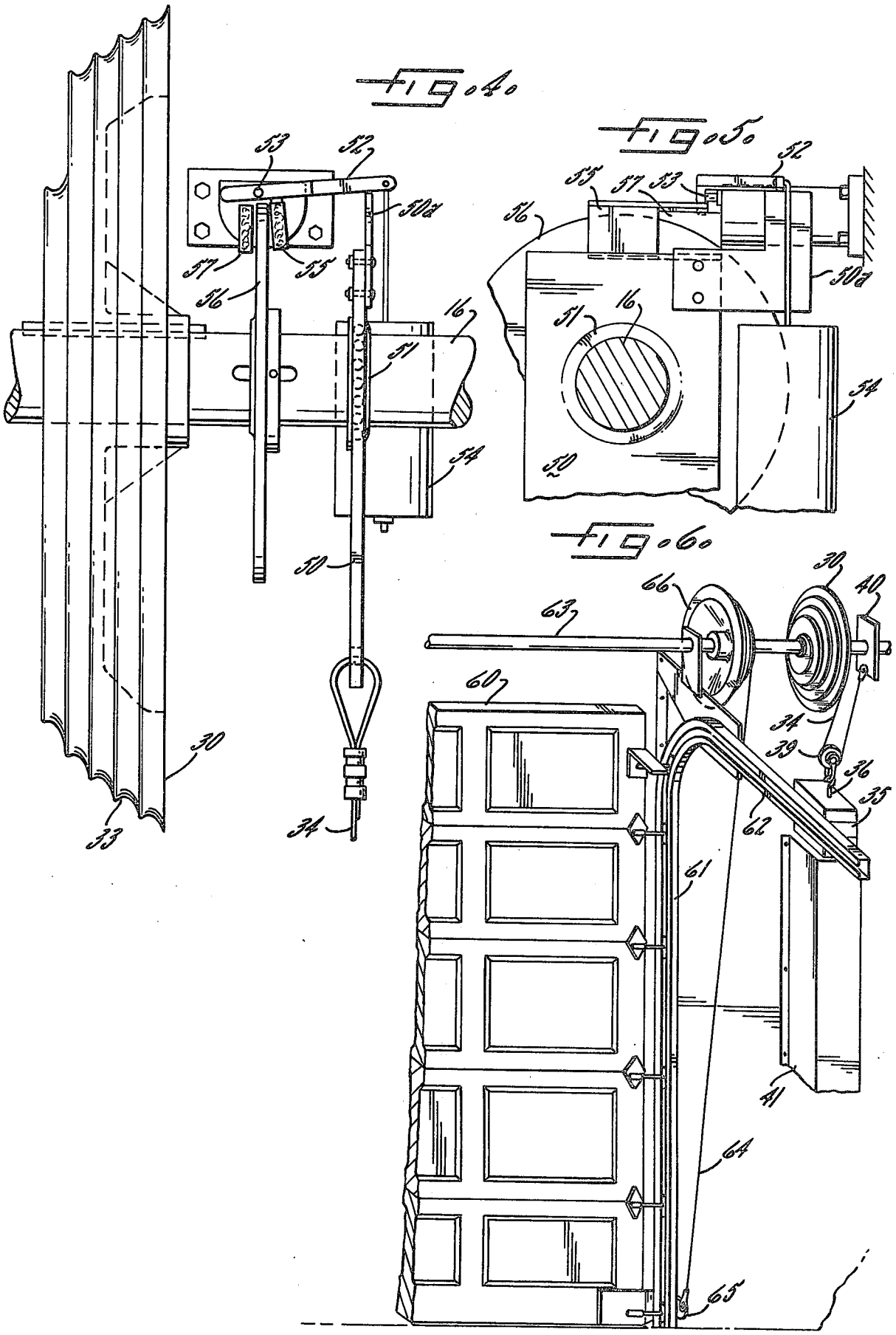
FIG. 4 is a side elevation of a safety brake for use in conjunction with the counterbalance mechanism of either FIGS. 1-3 or FIG. 4.
FIG. 5 is an end elevation of the safety brake shown in FIG. 4.
FIG. 6 is a perspective view of a different type of conventional door with a counterbalancing mechanism embodying this invention.

In the event of a break in the cable 34, or if the weights 35 become hung up so as to cause the cable 34 to go slack, the weight of the actuator 50 (particularly the top arm 50a) causes it to pivot in a clockwise direction as viewed in FIG. 5, thereby releasing the lever 52 for downward movement under the force of the weight 54. This causes the brake pad 55 to be brought into engagement with a brake disk 56 fixed to the shaft 16, thereby gripping the disk 56 between the brake pad 55 and a stationary brake pad 57 on the opposite side of the disk 56. Consequently, the disk 56 and thus the shaft 16 are locked against rotation to prevent any further movement of the door until the counterbalancing mechanism has been repaired. This is an important safety feature because it prevents the door from dropping toward its closed position at a rate much faster than anticipated, in the event of a malfunction in the counterbalancing mechanism.

In FIG. 6 there is illustrated an application of the counterbalance mechanism of this invention to a different type of door. In this case, the door 60 is an articulated wooden door which travels along a pair of tracks having a vertical run 61 alongside the doorway and a horizontal run 62 above the doorway for storing the door in the overhead space when it is in its open position. In this case, the door 60 is not normally driven by rotation of a shaft, but rather by manual movement of the door itself, or by means of an electric motor attached to an appropriate point on the door. In order to secure rotation of the shaft 63 on which the counterbalance drum 30 is mounted, a cable 64 is connected at one end to a bracket 65 on the bottom of the door and at the other end to a cable drum 66 fixed to the shaft 63. The drum 66 is a conventional cable drum used with certain types of rolling doors, and it has a spiral groove whose radius of curvature changes at a uniform rate from end to end.

When the door 60 is in the closed position shown in FIG. 5, the cable 64 is at the small-diameter end of the drum 66 so that the door 60 exerts a minimum torque on the shaft 63. As the door is opened, the weight of the door acting on the drum 66 gradually decreases, but the torque arm increases so that there is a net increase in the torque applied to the shaft 63 by the door. Thus it can be seen that without the secondary drum 66, it would be necessary for the radius of curvature of the spiral groove in the counterbalance drum 30 to change at a much faster rate. This would not only make fabrication of the drum 30 more difficult, but also would require a larger number of different counterbalance drums to accommodate any given number of different doors of different sizes and weights. That is, use of the secondary drum 66 permits a more gradual rate of change of the radius of curvature of the spiral groove in drum 30 so that the same counterbalance drum 30 can be used for a limited range of different doors. And a wider range of different doors can be served by a relatively small number of different counterbalance drums.

Another possible function of the counterbalancing mechanism of this invention is to provide automatic closing of the door in the event of a fire. This may be accomplished by dividing the counterbalancing weights into two parts, one of which is rendered inoperative in the event of a fire as detected by a fusible link, for example. Thus, an auxillary weight can be connected to the primary counterbalance weight by means of a pulley mounted on an actuator which is controlled by a conventional fusible link. In the event that the link is broken in response to a fire, the actuator releases the pulley supporting the auxillary weight so that that weight drops to the floor and no longer serves a counterbalancing function. In this case the primary weight is the only remaining counterbalancing source, and is insufficient to hold the door in its open position, as a result of which the door's own weight automatically moves it to the closed position to contain the fire. This arrangement also has a safety advantage because even after the door has been closed, a portion of the counterbalancing weight, namely that of the primary weight, remains applied to the door so that if someone would happen to be trapped inside the building after the door is closed, the door could still be opened manually because of the assist provided by the remaining counterbalance weight.

While the invention has been described with specific reference to certain preferred embodiments, it will be understood that various modifications can be made without departing from the spirit and scope of the invention. For example, various gears, levers and the like can be connected between the door and the counterbalance drum to divide or multiply the opposing forces of the door and the counterbalancing mechanism as desired.

As can be seen from the foregoing detailed description, the present invention provides a counterbalancing mechanism which has a long operating life because it does not include any torsional springs or similar elements which are subject to relatively early and repeated failures. This counterbalancing mechanism is conveniently mounted off to the side of the doorway so that it can be easily and quickly serviced if a malfunction ever occurs, such as a break in the cable. Moreover, both the installation and servicing of the counterbalancing mechanism can be easily carried out without obstructing the doorway, again because the counterbalancing mechanism is mounted off to the side of the doorway. Furthermore, this counterbalancing mechanism can be efficiently manufactured at a low cost, particularly in relation to the counterbalancing mechanisms that have been used heretofore for relatively large doors. Moreover, any given counterbalance drum can be used with doors having different sizes and weights, and with only a relatively small number of different drums, a wide variety of different doors can be accommodated so that it is not necessary to fabricate a different drum for each different door.

I claim as my invention:

1. A door assembly comprising a standard rolling door comprising a multiplicity of articulated sections mounted for movement vertically along the plane of the doorway and into a stored overhead position above the top of the doorway when the door is opened, the weight of the vertical portion of the door producing variable forces urging the door toward its closed position as the door is moved between its open and closed positions, and a counterbalancing mechanism comprising the combination of:

a. a horizontal shaft rotatably mounted above the doorway and operably connected to said door, and a drum fixed to said shaft for rotation therewith in response to movement of the door between its open and closed positions, said drum having a spiral groove formed in the outer surface thereof for guiding a cable along the drum when the drum is rotated, b. a cable connected to said drum and wrapped around said drum in said spiral groove in response to rotation of the drum in one direction and unwrapped from the drum in response to rotation in the opposite direction, the lengths of said cable and said spiral groove being such that the cable is completely unwrapped from the spiral groove when the door is in the open position, c. and a constant counterbalance weight suspended from said cable directly adjacent the doorway for applying a torque to said drum, and thus applying a force to said door, urging the door toward its open position, the radius of curvature of said spiral groove about the axis of said drum gradually decreasing along the length of the drum so that the torque arm between the axis of the drum and said cable gradually decreases as the door moves from its closed position to its open position for counterbalancing the variable forces urging the door toward its closed position, said radius of curvature decreasing at an increasing rate at the smaller end of the spiral drum so that the force applied to the door diminishes at an increasing rate as the door approaches the fully open position, said spiral groove terminating at about the outside diameter of the shaft in a radius of curvature that produces substantially zero torque on the drum, and thus the door, when the door is in its open position so that the door smoothly decelerates as it approaches said open position and is readily withdrawn from said open position for movement toward said closed position, said drum and weight providing the sole counterbalance for said door.

2. A counterbalancing mechanism as set forth in claim 1 wherein one end of said cable is connected to said drum and the other end is fixed, and said weight is suspended from an intermediate portion of the cable so that the weight displacement relative to the drum is only a fraction of the cable displacement relative to the drum.

3. A counterbalancing mechanism as set forth in claim 1 which includes braking means responsive to a reduction in the weight on said cable for locking said drum against rotation so that the door is automatically held in place in the event of a malfunction in the counterbalance mechanism, said drum being fixed to a rotatable shaft with one end of the cable being secured to the drum and the other end of the cable being secured to an actuator for said braking means.

4. A counterbalance mechanism as set forth in claim 1 wherein said drum is connected to a rotatable shaft carrying a secondary drum, and including a secondary cable connecting the secondary drum to said door, the secondary drum forming a spiral groove around the outer surface thereof for guiding the secondary cable along the secondary drum when the secondary drum is rotated, the radius of curvature of the spiral groove in the secondary drum gradually increasing along the length of the secondary drum so that the torque arm between the secondary cable and the axis of the secondary drum gradually increases as the door is moved from its open position to its closed position, thereby reducing the effective door weight to be counterbalanced.

5. A counterbalancing mechanism as set forth in claim 1 wherein the door is mounted for movement on a horizontal track at the top of the doorway.

6. A counterbalancing mechanism as set forth in claim 1 wherein the door is mounted to coil around a fixed axis at the top of the doorway.

7. A counterbalancing mechanism as set forth in claim 1 wherein a portion of the counterbalance weight is suspended by means for removing that portion of the weight from the spiral drum in response to a fire so that the door automatically closes itself with the remaining portion of the counterbalance weight still applied to the spiral drum.

* * * * *